US008893989B2

(12) United States Patent
Mueller

(10) Patent No.: US 8,893,989 B2
(45) Date of Patent: Nov. 25, 2014

(54) FUEL INJECTOR

(75) Inventor: Martin Mueller, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 208 days.

(21) Appl. No.: 11/983,460

(22) Filed: Nov. 9, 2007

(65) Prior Publication Data

US 2008/0149744 A1 Jun. 26, 2008

(30) Foreign Application Priority Data

Nov. 9, 2006 (DE) ..... 10 2006 052 817

(51) Int. Cl.

| | |
|---|---|
| ***F02M 61/18*** | (2006.01) |
| ***F02M 61/10*** | (2006.01) |
| ***F02M 61/06*** | (2006.01) |
| ***F02M 61/04*** | (2006.01) |
| ***F02M 51/06*** | (2006.01) |
| ***F02M 61/16*** | (2006.01) |

(52) U.S. Cl.

CPC ... *F02M 61/1873* (2013.01); *F02M 2200/9015* (2013.01); *F02M 61/1886* (2013.01); *F02M 61/166* (2013.01); *F02M 61/1893* (2013.01); *F02M 61/188* (2013.01); *Y10S 239/90* (2013.01)

USPC ..... 239/585.3; 239/533.11; 239/533.13; 239/585.1; 239/900

(58) Field of Classification Search

USPC ..... 239/900, 5, 533.2–533.14, 585.1–585.5

See application file for complete search history.

(56) References Cited

U.S. PATENT DOCUMENTS

| | | | | |
|---|---|---|---|---|
| 4,976,405 | A * | 12/1990 | Graner et al. | 251/129.16 |
| 5,199,648 | A * | 4/1993 | Fujikawa | 239/585.4 |
| 6,431,151 | B1 * | 8/2002 | Gmelin | 123/470 |
| 6,745,993 | B2 * | 6/2004 | Mueller | 251/50 |
| 6,899,291 | B2 * | 5/2005 | Liskow | 239/533.2 |
| 7,100,847 | B2 * | 9/2006 | Christ et al. | 239/533.12 |
| 7,438,242 | B2 * | 10/2008 | Ciampolini | 239/585.4 |
| 7,472,844 | B2 * | 1/2009 | Manubolu et al. | 239/533.2 |
| 2003/0222159 | A1 * | 12/2003 | Kobayashi et al. | 239/533.12 |
| 2006/0011749 | A1 * | 1/2006 | Kuegler et al. | 239/533.12 |

FOREIGN PATENT DOCUMENTS

| | | |
|---|---|---|
| DE | 198 59 484 | 7/2000 |
| DE | 103 38 081 | 3/2005 |
| JP | 7-239050 | 9/1995 |
| JP | 9-503267 | 3/1997 |
| JP | 10-231755 | 9/1998 |
| JP | 2003-65189 | 3/2003 |
| JP | 2003-519756 | 6/2003 |
| WO | WO 2005/075812 | 8/2005 |
| WO | WO 2006005639 A1 * | 1/2006 |

* cited by examiner

*Primary Examiner* — Darren W Gorman

(74) *Attorney, Agent, or Firm* — Kenyon & Kenyon LLP

(57) ABSTRACT

A fuel injector, particularly for the direct injection of fuel into a combustion chamber of an internal combustion engine, has an actuator for actuating a valve needle; at a spray-discharge end, the valve needle having a valve-closure member that, together with a valve-seat surface configured on a valve-seat member, forms a sealing seat at a seat-contact point; the valve-seat member and/or the valve-closure member being provided with at least one stiffness-reducing element.

6 Claims, 5 Drawing Sheets

FUEL INJECTOR

FIELD OF THE INVENTION

The present invention is based on a fuel injector of the type set forth in the main claim.

BACKGROUND INFORMATION

Inwardly-opening injection valves, both for direct injection in the high-pressure area and for manifold injection in the low-pressure area, usually have a valve seat in a ball/cone type of construction. That is, at the sealing point formed with the valve seat, the valve needle is configured with a ball or has a spherical form, and the valve seat is conical or hollow frustoconical.

However, in this type of fuel injectors, eccentricities, caused by the manufacturing process, of the seat contact points at the valve needle and at the valve seat often lead to leakages of fuel during operation of the valve.

A fuel injector provided with a spherical closing member is discussed, for example, in the German Patent DE 198 59 484 A1. A fuel injector for high-pressure injection of fuel from a central high-pressure delivery line into combustion chambers of an internal combustion engine has a valve seat, a valve ball and a guide member guiding the valve ball, which for its closure, presses the valve ball onto the valve seat, and for its opening, exposes the valve ball to an initial tension of a spring; the valve ball in the open state is lifted off from the valve seat by a high-pressure jet the valve ball in the open state is lifted off from the valve seat by a high-pressure jet which is supplied via an output throttle bore by a control chamber connected to a central high-pressure delivery line. The valve seat has an approximately steep-walled funnel shape having a right-angled to acute-angled cone angle. Because of the steep-walled funnel shape, the centering of the valve ball is assisted upon closure of the injection control valve, and a radial displacement of the valve ball with respect to a diffuser and the output throttle bore is prevented.

The German Patent DE 103 38 081 A1 discusses a further fuel injector of the type indicated above. In the fuel injector described there, an armature is formed in one piece with a valve needle. Provided in the valve needle are flow-through openings which direct the fuel, flowing through the fuel injector, to a sealing seat. The valve needle is operatively connected by welding to a spherical valve-closure member that, together with a valve-seat member, forms a sealing seat, and downstream of the sealing seat, a spray-orifice disk has formed in it at least one spray-discharge orifice from which fuel is injected into an intake manifold. The inner sealing of the fuel injector with respect to the intake manifold is dependent on the processing when manufacturing the fuel injector. During production of the valve-closure member with the sealing seat formed on it, a high surface quality with a relatively good sealing associated with it is attained by grinding and honing; however, this is qualified by the subsequent processes such as pressing the valve-seat member into the valve sleeve, and the joining of the components by a welded seam.

The above-mentioned fuel injectors having a spherical valve-seat member and hollow frustoconical valve-seat member have the disadvantage that eccentricities of the seat contact points at the valve needle and at the valve seat, caused by the manufacturing process, lead to leakages of fuel during operation.

SUMMARY OF THE INVENTION

In contrast, the fuel injector of the exemplary embodiment of the present invention having the characterizing feature of the main claim has the advantage that, because of the stiffness-reducing elements provided on the valve-seat member and/or on the valve-closure member, the seat area of the fuel injector is made elastically softer, and therefore eccentricities at the seat contact points are elastically pressed over by the contact force. The fuel leakage during operation therefore becomes less. The wear of the fuel injector thereby becomes less as well, because due to the elastic conformation of the two seat elements, the contact force is distributed on a larger seat area. The contact force may also be selected to be less. The wear and the operating speed of the valve are positively influenced in this manner.

An especially positive effect is achieved if both the valve-seat area and the valve-closure member are provided with stiffness-reducing elements, an optimal conformation of the two components thereby resulting.

A stiffness-reducing element is formed particularly easily from the standpoint of production engineering by providing a recess in the form of a circumferential groove encircling an outer peripheral surface of the valve-closure element. A stiffness-reducing element may be produced in this easy manner in the valve-seat member as well, by providing a groove in the inner peripheral surface of the valve-seat member that extends almost to the seat-contact point. Because support material is missing behind the seat-contact point, it is made soft.

To reduce the stiffness of the valve-seat member, it is likewise advantageous if it is made thin-walled, so that it becomes flexible or soft in this thin-walled area. The stiffness is reduced still further if the valve-closure member has both an outer circumferential recess in the form of a circumferential groove, and moreover a second stiffness-reducing recess in an inner area.

The valve-seat areas may also be made soft or flexible by using suitable soft materials.

For reasons of fluid mechanics, it is also advantageous if the recesses are filled with a soft material such as plastic.

An exemplary embodiment of a fuel injector according to the present invention is represented in simplified form in the drawings and is elucidated and described in detail in the following description.

DETAILED DESCRIPTION

Figure 1:
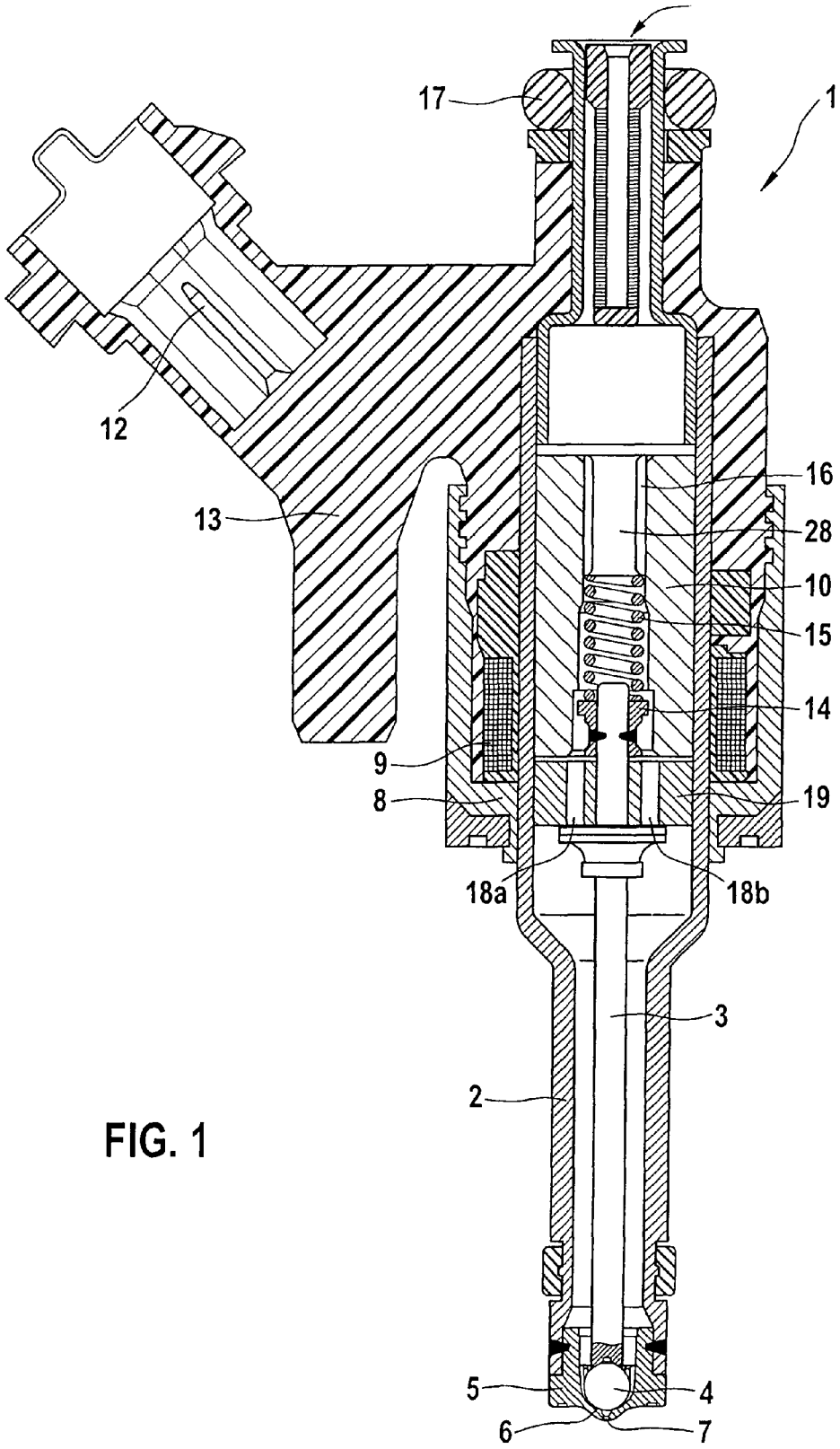
FIG. 1 shows a schematic cross-section through a fuel injector.

FIG. 1 shows a schematic cross-section through a fuel injector 1. Fuel injector 1 is configured in the form of a fuel injector for fuel-injection systems of mixture-compressing internal combustion engines with externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 is in operative connection with a spherical valve-closure member 4, which cooperates with a valve-seat surface 6, located on a valve-seat member 5, to form a sealing seat. In the exemplary embodiment, fuel injector 1 is an inwardly opening, electromagnetically actuated fuel injector 1 which has a spray-discharge orifice 7.

Solenoid coil 9 is wound on a coil brace which rests against an inner pole 10 of solenoid coil 9. Inner pole 10 and external pole 8 are separated from each other by a gap. Solenoid coil 9 is energized via a line by an electric current, which may be supplied via an electrical plug contact 12. Plug contact 12 is enclosed by a plastic coating 13, which is extrudable onto inner pole 10.

An armature 19 is non-positively connected via a first flange 14 to valve needle 3, which, for example, may be joined to first flange 14 by a welded seam. Braced on first flange 14 is a restoring spring 15, which is prestressed by a sleeve 16 in the present design of fuel injector 1.

Running in armature 19 and in valve-seat member 5 are fuel channels 18*a*, 18*b* which conduct the fuel, supplied via a central fuel feed 11, to spray-discharge orifice 7 in valve-seat member 5. Fuel injector 1 is sealed off from a distributor line (not shown) by a seal 17.

In the rest state of fuel injector 1, restoring spring 15 acts, via first flange 14 at valve needle 3, upon armature 19 counter to its lift direction in such a way that valve-closure member 4 is held in sealing contact against valve-seat surface 6. When excited, solenoid coil 9 generates a magnetic field which moves armature 19 in the lift direction counter to the spring force of restoring spring 15, the lift being defined by a working gap occurring between inner pole 10 and armature 19 in the rest position.

Armature 19 also carries along first flange 14, which is welded to valve needle 3, and thus valve needle 3 in the lift direction as well. Valve-closure member 4, in operative connection with valve needle 3, lifts off from valve-seat surface 6, and the fuel arriving at spray-discharge orifice 7 via fuel channels 18*a*, 18*b* is ejected.

If the coil current is switched off, once the magnetic field has sufficiently decayed, armature 19 falls away from inner pole 10 due to the pressure of restoring spring 15 on first flange 14, whereby valve needle 3 moves counter to the lift direction. As a result, valve-closure member 4 comes to rest on valve-seat surface 6, and fuel injector 1 is closed. The electromagnetic circuit forms an actuator 28.

Figure 2A:
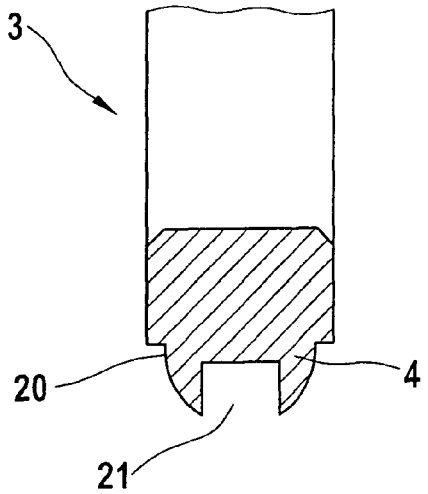
FIGS. 2*a*-2*e* show respective specific embodiments of stiffness-reducing elements which are provided on the valve-closure member.
Figure 2B:
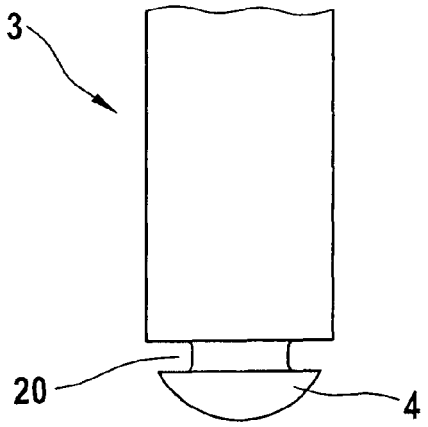
Figure 2C:
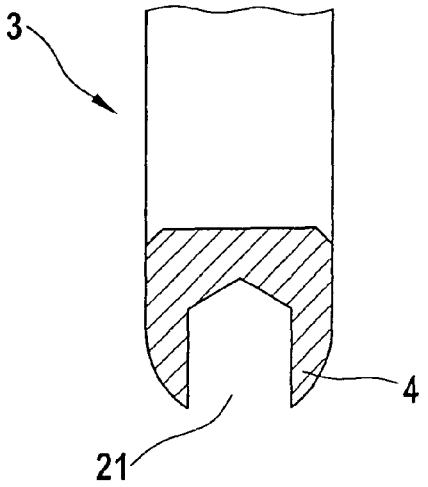

FIGS. 2*a* through 2*c* show specific embodiments of stiffness-reducing elements, which are provided on the valve-closure member.

In the specific embodiment shown in FIG. 2*a*, a valve needle 3 has a valve-closure member 4 that is formed integrally with valve needle 3 and is rounded off at the downstream end. As stiffness-reducing element, valve-closure member 4 has both a circumferential recess 20 (first stiffness-reducing element) at its outer periphery, and a second recess 21 (second stiffness-reducing element), which is provided at the downstream end of rounded-off valve-closure member 4.

FIG. 2*b* shows a further specific embodiment in which at its downstream end, a valve needle 3 again has a rounded-off valve-closure member 4 formed integrally with valve needle 3. In contrast to the exemplary embodiment shown in FIG. 2*a*, the valve-closure member here has only one stiffness-reducing element in the form of a circumferential recess 20 configured as a circumferential groove.

In the further exemplary embodiment shown in FIG. 2*c*, the valve-closure member again has only one stiffness-reducing element, this time, however, as recess 21 provided in the downstream end of the valve-closure member. The stiffness-reducing elements in the form of recesses provided in the respective valve-closure members shown make the seat-contact area soft, so that eccentricities at the seat-contact points are pressed over by the contact force, and the fuel leakage during operation therefore decreases.

Figure 2D:
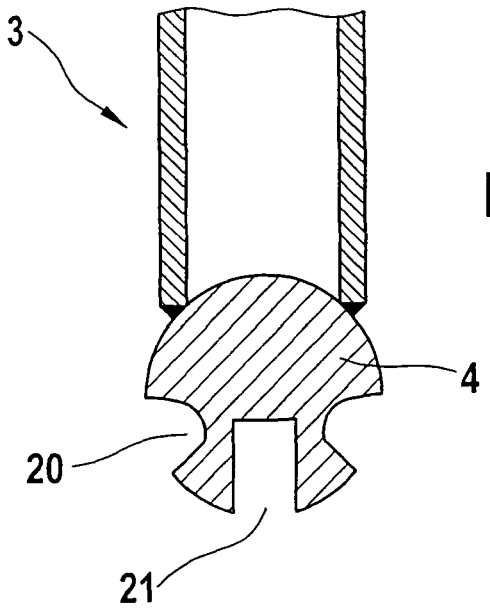

The exemplary embodiment shown in FIG. 2*d* is similar to that shown in FIG. 2*a* in that as stiffness-reducing element, valve-closure member 4 has both a circumferential recess 20 (first stiffness-reducing element)—whose shape, however, differs from that in FIG. 2*a*—at its outer periphery, and a second recess 21 (second stiffness-reducing element), which is provided at the downstream end of rounded-off valve-closure member 4.

Figure 2E:
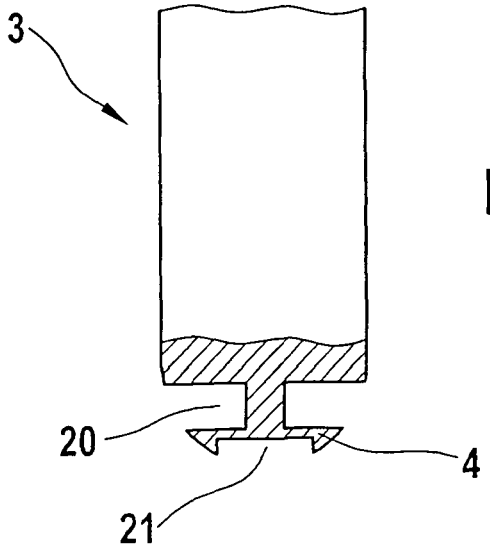

Finally, FIG. 2*e* shows yet another exemplary embodiment having two stiffness-reducing elements in the form of a first recess 20 and a second recess 21, whose shapes and dimensions differ from the shapes shown in FIGS. 2*a* and 2*d*, however.

Figure 3:
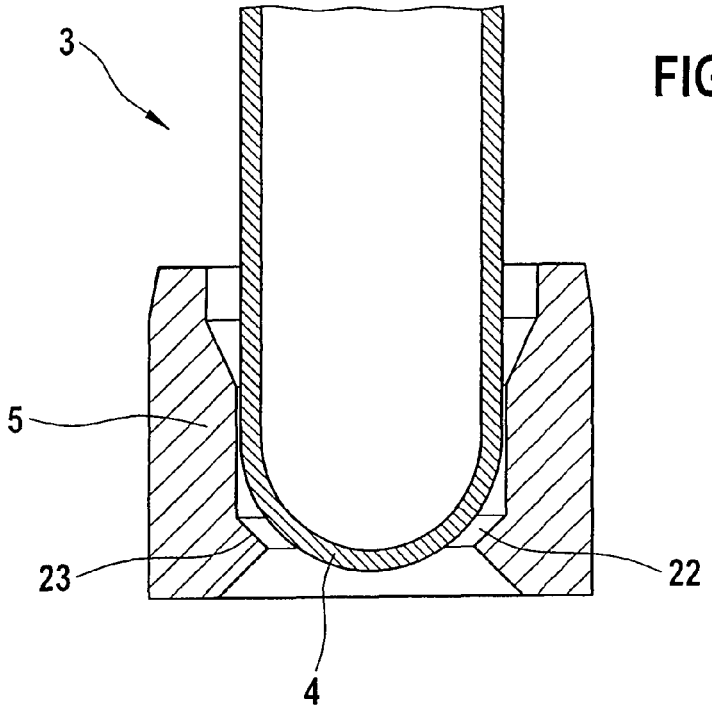
FIG. 3 shows a further specific embodiment of a stiffness-reduced valve-closure member.

FIG. 3 shows a further specific embodiment of a stiffness-reduced valve-closure member 4. In this case, valve-closure member 4 is again provided at the downstream end of valve needle 3, and is formed integrally with it. Both valve needle 3 and rounded-off valve-closure member 4 are hollow and thin-walled. They are thereby particularly soft and flexible at seat-contact point 23. Valve-seat member 5 also has a recess 22 in the area of seat-contact point 23. Because of the lack of support material behind the seat-contact point, it likewise becomes soft, which permits an elastic conformation of the elements.

Figure 4:
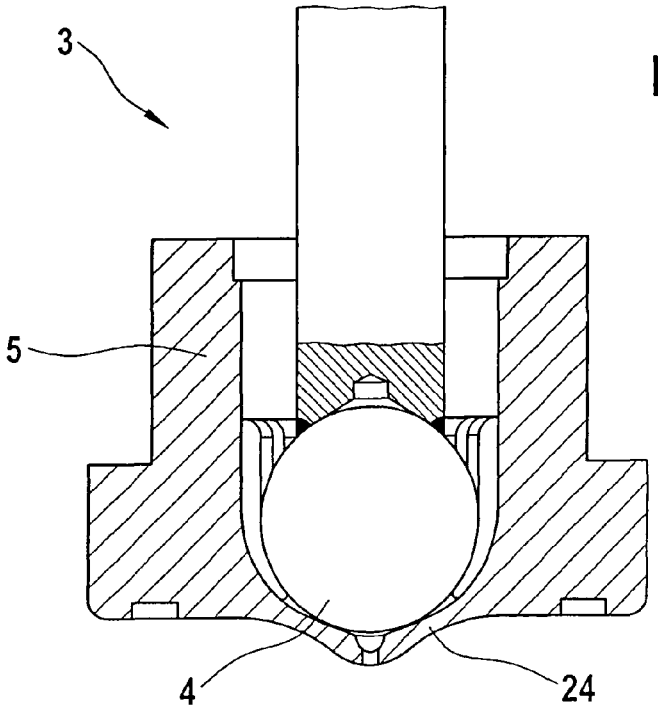
FIG. 4 shows a specific embodiment in which the stiffness-reducing element is provided on the valve-seat member.

FIG. 4 shows a further specific embodiment in which the stiffness-reducing element is provided on valve-seat member 5, by making valve-seat member 5 thin-walled in contact area 24 in which valve-closure member 4, here in the form of a ball which is provided at the downstream end of valve needle 3, is in contact with valve-seat member 5 when the valve is closed.

Figure 5:
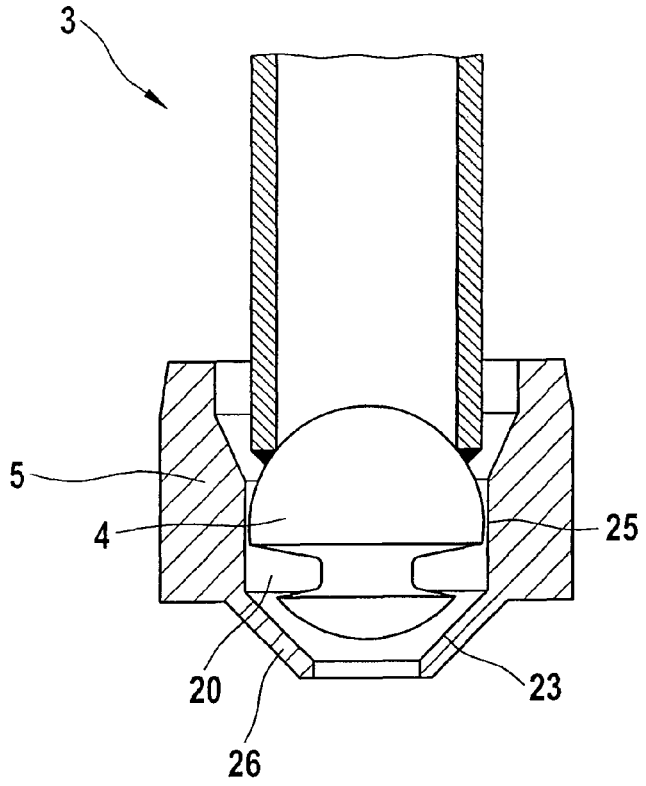
FIG. 5 shows a specific embodiment in which the stiffness-reducing elements are provided both on the valve-closure member and on the valve-seat member.

FIG. 5 shows still another specific embodiment in which the stiffness-reducing elements are provided both on valve-closure member 4 and on valve-seat member 5. As in the exemplary embodiment shown in FIG. 4, a valve-closure member 4 is configured as a ball and is attached, e.g., by welding, at the downstream end of valve needle 3. Valve-closure member 4 has a recess 20 in the form of a groove encircling the outer periphery of the ball. The groove extends up to seat-contact point 23.

Valve-seat member 5 has a hollow-cylindrical section 25 and, adjacent to it, a hollow frustoconical section 26 which is thin-walled and includes seat-contact point 23. Both components, i.e., valve-closure member 4 and valve-seat member 5, thereby become soft and capable of conforming.

Figure 6:
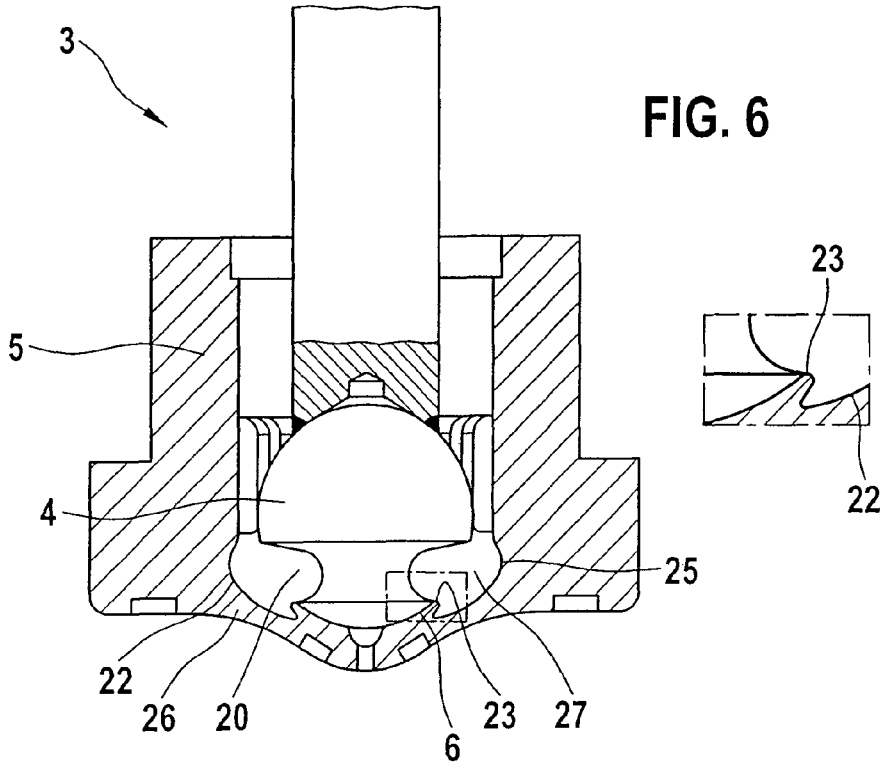
FIG. 6 shows a further specific embodiment in which the stiffness-reducing elements are provided both on the valve-closure member and on the valve-seat member.

Finally, FIG. 6 shows yet another specific embodiment in which the stiffness-reducing elements are provided both on valve-closure member 4 and on valve-seat member 5. Valve-closure member 4 corresponds to valve-closure member 4 shown in FIG. 5, and therefore is not described again. Valve-seat member 5 is likewise similar to valve-seat member 5 shown in FIG. 5, but additionally has a circumferential recess 22 in the form of a circumferential groove on valve-seat surface 6, the groove being provided before seat-contact point 23 and extending from thin-walled, frustoconical section 26 into hollow-cylindrical section 25, and together with the circumferential groove of valve-closure member 4, enclosing a hollow space. A segment framed by broken lines is shown enlarged to the right next to FIG. 6, in order to show recess 22 at seat-contact point 23 in detail.

For reasons of fluid mechanics, the grooves both in valve-closure member 4 and in valve-seat member 5 may be filled with a soft material such as plastic, which is not shown in the figures. The exemplary embodiment of the present invention is also valid for hydraulically driven diesel nozzles.

What is claimed is:

1. A fuel injector for directly injecting fuel into a combustion chamber of an internal combustion engine, comprising:

an actuator; and a valve needle which is actuatable by the actuator, the valve needle at a spray-discharge end having a spherical valve-closure member, which together with a single valve-seat surface configured on a valve-seat member, forms a sealing seat at a seat-contact point, wherein the valve-seat member and the valve-closure member are provided with at least one stiffness-reducing element in the region of the sealing seat, wherein the stiffness-reducing element is formed on the valve-closure member as a recess, which is a circumferential groove, which surrounds an outer periphery of the spherical valve-closure member, wherein the stiffness is reduced at least principally due to the recess, wherein the recess lies upstream from the single valve-seat surface or the seat-contact point, wherein a lower section of the spherical valve-closure member cooperates with the valve-seat surface of the valve-seat member to form the sealing seat such that, when the valve is closed, the sphere of the valve-closure member rests against the valve seat member which valve seat member is conically tilted or spherically concavely curved, wherein the valve-seat member is thin-walled at least in the area of the seat-contact point.

2. The fuel injector of claim 1, wherein the recess on the valve-closure member extends up to the seat-contact point with the valve-seat member.

3. The fuel injector of claim 1, wherein the valve-seat member is produced at least partially from a soft plastic material.

4. The fuel injector of claim 1, wherein the recess is filled with a soft plastic material.

5. The fuel injector of claim 1, wherein the valve-seat member includes a hollow frustoconical section and a hollow cylindrical section.

6. The fuel injector of claim 5, wherein the recess extends from the hollow frustoconical section into the hollow cylindrical section.

* * * * *